United States Patent [19]

Marcoz

[11] 4,213,109

[45] Jul. 15, 1980

[54] ELECTROMAGNETIC TRIPPING DEVICE

[75] Inventor: Bruno Marcoz, Nogent-sur-Marne, France

[73] Assignee: Compagnie Generale d'Appareillage Electrique C.G.A.E., Paris, France

[21] Appl. No.: 929,694

[22] Filed: Jul. 28, 1978

[51] Int. Cl.[2] ..... H01H 9/20

[52] U.S. Cl. ..... 335/174; 335/254

[58] Field of Search ..... 335/174, 175, 170, 171, 335/173, 172, 253, 254, 229, 230, 238, 179

[56] References Cited

U.S. PATENT DOCUMENTS 3,783,422 1/1974 Taylor ..... 335/174

*Primary Examiner*—Harold Broome

*Attorney, Agent, or Firm*—Silverman, Cass & Singer, Ltd.

[57] ABSTRACT

An electromagnetic tripping device for protecting a printed circuit card by opening an electrical circuit of the card in response to an overcurrent of the circuit. The device includes contacts and an energizing coil which are connected in series with the circuit to be opened. When the contacts of the device are closed and the circuit current is normal, a magnetic holding flux provided by a bar magnet holds a plate in contact with two spaced and parallel side-walls between which is located the bar magnet. When an overcurrent occurs, the energizing coil produces a breaking flux which reduces the holding flux sufficiently so that the plate may be moved from the side-walls by a return spring, thereby opening the contacts and the circuit. When the plate is moved from the side-walls, an actuating rod which passes through an opening in the plate is projected out of the device housing to indicate the opening of the circuit. An axial force applied to the projecting end of the actuating rod allows the plate to be reset in contact with the side-walls by an auxiliary spring to reset the device with a like amount of force each time.

8 Claims, 3 Drawing Figures

ELECTROMAGNETIC TRIPPING DEVICE

BACKGROUND OF THE INVENTION

The present invention relates to and has essentially for its object an electromagnetic tripping device, forming for example a relay, circuit breaker or like current interrupting means, designed to meet more particularly two categories of new requirements, i.e., on the one hand, miniaturization of such devices, and on the other hand, the suitability of such miniaturized devices for their most currently contemplated use, namely, their mounting on printed-circuit cards as any other electronic components.

Accidents with catastrophic consequences have recently occured in certain data processing centers and telephone exchanges using important digital processing installations. In such cases, whole cabinets full of printed-circuit cards plugged side by side into connectors arranged in rows are enclosed in a same room. The printed-circuit cards are usually arranged vertically in order to facilitate ventilation and the spacing between the cards in a same row is practically standardized to correspond to the maximum width of the largest electronic components used. A complete installation of this kind using several cabinets full of electronic components is obviously very expensive. On the other hand, the risks of failure of the installation are not inconsiderable in view of the number of components. It has happened that a fault in just one printed-circuit card resulting in a short circuit has started a fire which has destroyed the whole installation. Designers have therefore recognized the necessity for equipping each printed-circuit card with one or several individual circuit breakers designed to immediately cut out at least part of the card on occurence of an abnormal current at the card, e.g. in the direct-current supply. The needed next type of circuit breaker was therefore a miniature circuit breaker with the following mutually conflicting characteristics:

it had to be miniaturized in the extreme in order to be of a size compatible with the mean size of the electronic components mounted on the printed-circuit cards of present-day digital processing systems, in particular, it must have a minimum base area in order not to be too difficult to be mounted on the printed-circuit card, and its height must be greater than the usually adopted spacing between the cards arranged vertically within a common cabinet, its sensitivity must be increased so as to be compatible with the usual orders of magnitude of the supply currents for such printed-circuit cards, lastly and above all, the tripping knob must be arranged on the side of the circuit-breaker housing so that when the housing is adequately mounted on the card the said knob is readily accessible and does not prevent other components being mounted in immediate proximity to the circuit breaker.

Devices meeting such requirements in association with those of miniaturization proper (reduced number of members, accurate assembly, etc.) are practically unavailable on the market. The present invention is the result of extensive research with a view to making all such requirements compatible with one another. Otherwise stated, the shape and arrangement of the components of the device according to the invention as well as its external appearance have been conceived essentially for its contemplated application. However, the same basic structure may be quite easily reutilized to develop an electromagnetic relay with quite as interesting performances.

SUMMARY OF THE INVENTION

To this end, the invention relates to an electromagnetic tripping device characterized in that it comprises:

two substantially flat flux-conductive side-walls or cheeks spaced in substantially parallel relationship to one another, a bar magnet forming a cross-tie between the said side walls, the direction of magnetization of the said bar magnet being perpendicular to the mutually confronting surfaces of the said side walls, an energizing or tripping coil wound around a flux-conductive core forming between the said side walls a cross-tie parallel with the direction of magnetization of the said bar magnet, an actuating rod carrying a transverse, magnetic-circuit closing plate, the said rod and the said plate being guided in translation in a common direction perpendicular to the said direction of magnetization, the said plate being movable into engagement with the respective coplanar edges of the said side walls, and a return spring bearing against the assembly of the said actuating rod and said plate, in a direction tending to move the plate away from the said coplanar edges.

It is understood that in such a structure, where the movement of the movable part (actuating rod and transverse plate) takes place perpendicularly to the direction of magnetization of the bar magnet and to the axis of the coil, both a reduced base area facilitating the mounting on the printed-circuit card is obtained and the occupied space in height with respect to the plane of the card is minimized since the actuating rod, (which, in the case of a circuit breaker, also serves as an actuating knob) moves in a parallel direction to the plane of the card.

BRIEF DESCRIPTION OF THE DRAWINGS

The invention will be better understood and other objects, details and advantages of the latter will appear more clearly from the following explanatory description of a particular form of embodiment of a circuit breaker according to the invention, given solely by way of example and with reference to the appended non-limitative drawings wherein.

DESCRIPTION OF THE PREFERRED EMBODIMENT

Figure 1:
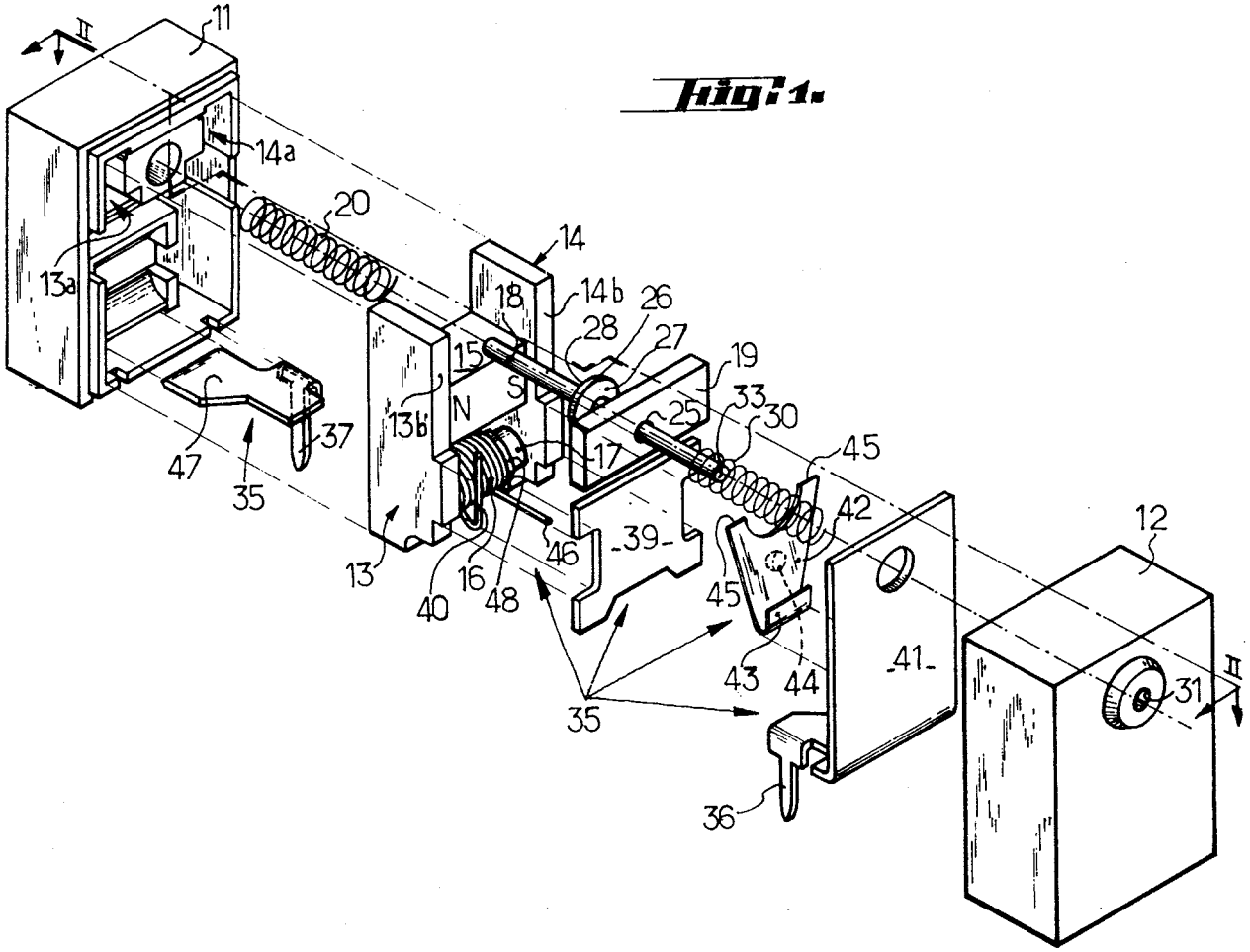
FIG. 1 is an exploded view of a circuit-breaker device according to the invention.

Shown in the drawings is a miniature electric-circuit breaker or like electric current interrupting device comprising essentially two half-casings 11 and 12 forming the protective insulating housing of the device, two flat metal side-plates or cheeks 13 and 14 in spaced parallel relationship to one another, a bar magnet 15, an energizing or tripping coil 16 wound around a cylindrical flux-conductive core 17, an actuating rod 18 carrying a transverse metal plate 19 serving to close the magnetic circuit, and a helical return spring 20. The bar magnet 15 and the core 17, which are mutually parallel and equal in length, form cross-ties or the like between the side plates 13 and 14, as can be seen in FIG. 1. It should be noted, however, that this is not indispensable as far as the bar magnet 15 is concerned, since a gap may be provided between the bar magnet and the side walls 13, 14. The direction of magnitization N-S of the bar magnet 15 is perpendicular to the mutually opposite surfaces of the side walls 13 and 14. The side walls are positioned and adhesively retained in lateral cavities $13_a$, $14_a$ provided in the half-casing 11, so that their edges $13_b$, $14_b$ project outwardly of the said half-casing. Preferably, after adhesively securing the side walls in the half-casing 11, the edges $13_b$, $14_b$ are planed, as by grinding, so as to render them rigorously coplanar. Such mounting and machining features are important since the edges $13_b$ and $14_b$ provide the bearing surface for the movable transverse plate 19 when the circuit breaker is operative. The plate 19 is provided with a central hole 25 the diameter of which corresponds to that of the rod 18 so as to allow for relative sliding motion between the rod 18 and the plate 19. Furthermore, the rod 18 is provided with a transverse stop collar 26 displaying two opposite bearing faces 27 and 28 so that the plate 19 can bear against the face 27 whereas the return spring 20 coaxially surrounding the rod 18 bears against the opposite face 28. The transverse plate 19 is urged towards the bearing face 27 by an auxiliary helical spring 30, but this auxiliary spring is designed so that the force which it exerts on the plate 19 is markedly smaller than that of the return spring 20 applied to the face 28 of the stop 26. As the previously mentioned spring, the spring 30 is arranged coaxially around the rod 18 on the other side of the stop 26 with respect to the spring 20.

The actuating rod 18 and the transverse plate 19 are guided in translation within the housing in perpendicular relationship to the direction of magnetization N-S, this movement being stopped in one direction when the plate 19 moves into engagement with the ground coplanar surfaces $13_b$, $14_b$. The guiding of the rod 18 is ensured in the simplest manner by means of two mutually opposite apertures 31, 32 provided in the half-casings 11 and 12, respectively. Furthermore, the end 33 of the rod portion carrying the auxiliary spring 30 projects laterally outside the housing in at least the open or break position (shown in phantom lines in FIG. 2) of the device. The end 33 thus forms the reset knob of the circuit breaker.

Figure 2:
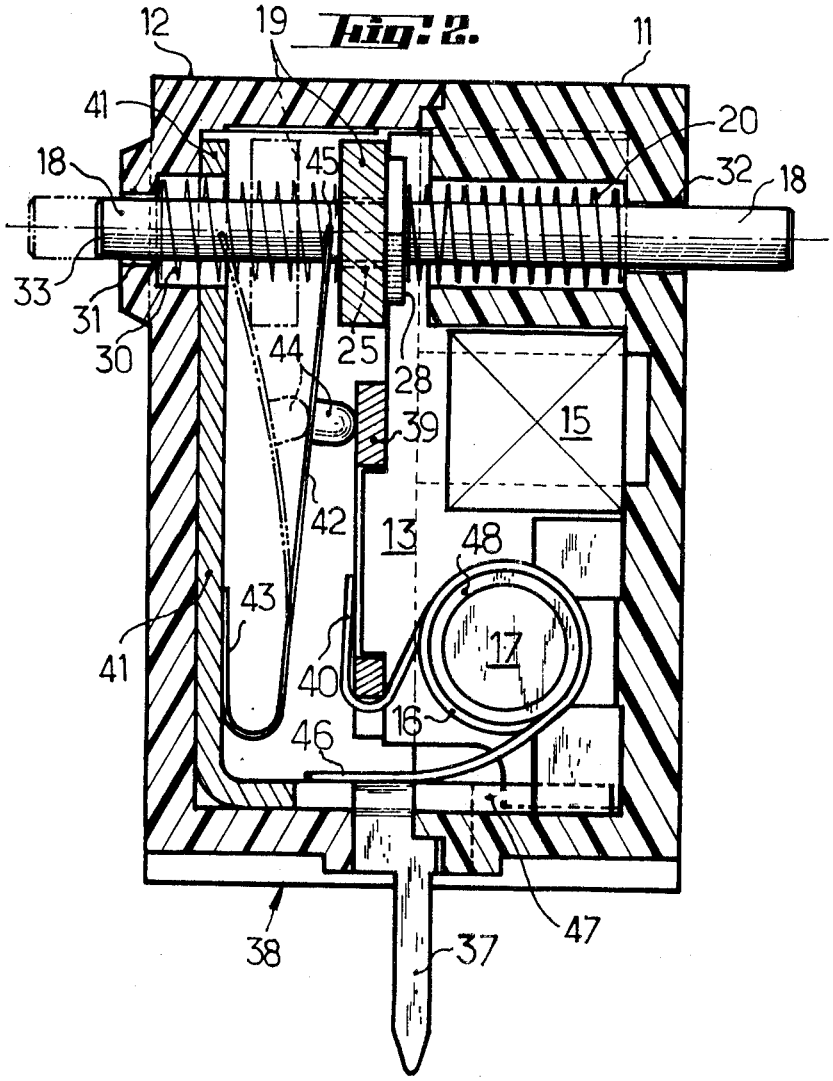
FIG. 2 is a sectional view, to a larger scale, of the same device upon the line II—II of FIG. 1, showing all the components of the device mounted in their respective functional co-operating positions.

The two half-casings 11 and 12 also accomodate a break circuit 35 including of course the above-mentioned coil 16. This circuit comprises two plug-in pins or access terminals 36, 37 projecting from the base face 38 of the housing formed by the two half-casings 11 and 12 assembled together (FIG. 2). It is therefore seen that in accordance with what has been said earlier, the base face 38 and the actuating rod 18 are located as far apart as possible, and the actuating rod 18 is adapted to move in a parallel direction to the said base face. The break circuit 35 comprises a first metallic collecting pole 39 electrically connected (welded) to the end 40 of the coil 16, a second metallic collecting pole 41 parallel with the first collecting pole and electrically connected to (in fact an extension of or prolonged by) the access terminal 36, and a flexible metallic contact blade 42, located between the two said poles and secured (welded) to the second pole 41 by its curved portion 43. The flexible blade 42 carries a contact stud 44 forming with the first pole 39 the breaking means proper. The freely movable endmost portion 45 of the flexible blade 42 is placed on the path of movement of the transverse plate 19 (which path is symbolized by the two endmost positions of plate 19 shown in FIG. 2 in full lines and interrupted lines, respectively) so as to be pushed by the said plate towards the left in FIG. 2, i.e. towards the second pole 41, when the device is in its open or break position. On the other hand, it should be noted that when the device is not open, i.e. when the transverse plate 19 is applied to the coplanar edges $13_b$ and $14_b$ of the side walls 13 and 14, the contact blade 42 is disengaged from the transverse plate 19 and applied through its contact stud 44 to the first pole 39.

The other end 46 of the coil 16 is connected (welded) to a third metallic collecting pole 47 resting on the bottom wall of the housing and electrically connected to (in fact prolonged by or an extension of) the other access terminal 37.

Lastly, another important feature of the invention lies in the fact that a metal screen tube 48, e.g. of copper or brass, is interposed between the coil 16 and its core 17. When a current flows through the coil the said screen tube performs the function of a short-circuit turn through which a current induced by the coil passes. This results in retarding core induction. By these simple means the circuit breaker is prevented from being tripped by false alarms caused by transient current peaks of short duration, therefore involving no danger for the installation.

Figure 3:
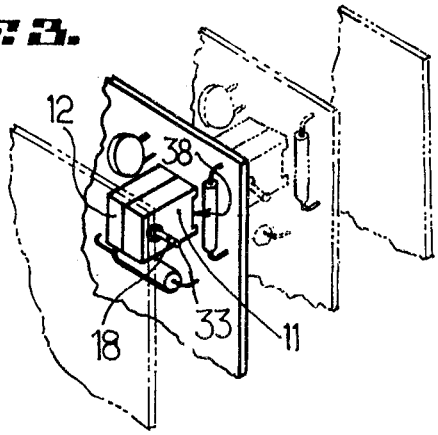
FIG. 3 shows the same device, in substantially actual size, mounted on a printed-circuit card of a complex electronic system.

The operation of the device just described is quite simple and can be obviously inferred from the foregoing description. The rod 18 being depressed towards the right in FIG. 2, the plate 19 is applied to the edges $13_b$ and $14_b$ of the side walls 13 and 14. The magnetic field of the bar magnet 15 therefore closes through the transverse plate 19 remaining applied with a certain force to the edges $13_b$ and $14_b$. This application force is of course greater than the force exerted by the spring 20 on the stop 26. If, however, a current flows through the coil 16, the flux in the core 17 increases against the flux of the bar magnet 15. This aggregately results in a decrease in the force of attraction of the plate 19 against the side walls 13 and 14. When the current in the coil 16 reaches a definite threshold accurately predetermined by appropriately selecting the characteristics of the coil, the bar magnet 15 and the spring 20, the force of application of the transverse plate 19 becomes smaller than the force exerted by the spring 20, thus releasing the actuating rod 18 and displacing it towards the left in FIG. 2. During this movement the rod 18 drives along with it the transverse plate 19 which in its turn repels or moves the flexible contact blade 42 thus opening the break circuit 35 and interrupting the flow of current between the terminals 36 and 37 of the device. The end 33 of the rod 18 then noticeably protrudes from the housing of the device, thus showing that the device is in its open position. So, an operator entrusted with the supervision of the electronic system diagrammatized in FIG. 3, is able to immediately locate any fault that may occur, by checking the condition of the circuit breakers mounted on the various printed-circuit cards. After eliminating the fault and, if necessary, changing the faulty card, the new card may be cut in by simply pressing on the end 33 of the rod 18, thus reapplying the transverse plate 19 to the coplanar edges $13_b$ and $14_b$ of the side walls 13 and 14. The plate 19 then remains in that position until such time as a further abnormal current is detected. In this connection, an important advantage of the resetting system just described should be noted. It has indeed been found that the tripping threshold of a circuit breaker may vary according to the manner in which the operator resets the device subsequent to breaking, more particularly in accordance with the force with which he presses on the resetting knob. It will be observed that in the arrangement described it is not the operator's actuating force that reapplies the transverse plate 19 onto the edges $13_b$, $14_b$ (this force serving only to move the rod 18 against the action of the spring 20) but rather the combined return forces of the spring 30 and the flexible contact blade 42. Otherwise stated, the resetting pressure on the transverse plate 19 is always the same or identical with itself and corresponds to a value selected by the manufacturer. It will also be observed that the auxiliary spring 30 is not indispensable, for the return travel of the flexible contact blade 42 is often sufficient to move the transverse plate to a location very close to the edges $13_b$ and $14_b$, where there is a sufficient magnetic field to cause the plate 19 to be magnetically attracted towards the cheeks 13, 14, thus completing its resetting travel.

Of course the invention is by no means limited to the form of embodiment just described which has been given by way of example only. In particular, the same basic system may be used to obtain a relay instead of a circuit breaker, in which case the flexible blade 42 becomes useless and can be dispensed with. It is then sufficient to add a system of movable contacts whose actuation may be, for example, mechanically connected to the motion of the rod 18. Instead of a system of contacts there can also be provided any suitable mechanical system, in particular the operating member of a valve, etc. The invention therefore covers all technical equivalents to the means described should the latter be used within the scope of the following claims.

What is claimed is:

1. An electromagnetic tripping device comprising in combination:

(a) two magnetic flux conductive side-walls spaced in substantially parallel relationship to each other with each side-wall including an edge which is coplanar with an edge of the other side-wall;

(b) bar magnet means extending between the side-walls for forming a magnetic holding flux in a direction perpendicular to said side-walls;

(c) energizing coil means extending between said side-walls for producing a magnetic breaking flux in a direction parallel to said magnetic holding flux in response to an electrical signal being applied thereto, said energizing coil means including first and second leads across which said electrical signal is applied;

(d) a magnetic flux conductive transverse plate adjacent said side-walls, said transverse plate being movable from a contact position in which said plate is in contact with both of said coplanar edges to close a magnetic circuit of said holding flux through said side-walls and said bar magnet means, and a break position in which said transverse plate is spaced from both of said coplanar edges, said transverse plate being held in said contact position by said holding flux and said transverse plate including an opening therethrough;

(e) an actuating rod freely passing through said opening, and guide means for guiding said actuating rod and transverse plate in translation along a same direction of displacement which is perpendicular to said direction of said magnetic holding flux;

(f) return spring means coupled to said actuating rod and said transverse plate for applying a tripping force thereon in a direction which will move said transverse plate from said contact position; and (g) a breaking circuit including said energizing coil means, a first collecting pole adjacent said side-walls and electrically connected to said first lead of said energizing coil means, a second collecting pole arranged parallel with said first collecting pole and including a first terminal, a contact blade located between said first and second collecting poles, said contact blade including one end secured to said second collecting pole, another end in the path of movement of said transverse plate and a flexible portion extending between said one and said other end, said contact blade being movable by said transverse plate from being in electrical contact with said first collecting pole and closing said breaking circuit when said transverse plate is in said contact position to being out of contact with said first collecting pole and opening said breaking circuit when said transverse plate is in said break position, and a third collecting pole electrically connected to said second lead of said energizing coil means and including a second terminal, so that when said transverse plate is in said contact position and an electrical signal in excess of a predetermined value is applied across said first and second terminals said breaking flux reduces said holding flux so that said transverse plate is moved to said break position by said return spring means which moves said contact blade and opens said breaking circuit.

2. The device as claimed in claim 1 in which said energizing coil means include a coil wound around a flux conductive core and said energizing coil means form a cross-tie between said side-walls.

3. The device as claimed in claim 2 in which there is a metal screen tube between said coil and core for retarding core induction to prevent said device from being actuated by transient current peaks of short duration which may be applied to said terminals.

4. The device as claimed in claim 1 in which there is a protective housing including two half casings, said side-walls being secured in one of said half casings with at least said coplanar edges projecting out of said one half casing, said coplanar edges being planed after being secured in said one half casing to ensure a reliable contact with said transverse plate.

5. The device as claimed in claim 4 in which said first and second terminals project from a base of said housing, and in which said actuating rod is adapted to move in parallel relationship with said housing base with at least one end of said actuating rod projecting outwardly of said housing when said breaking circuit is open.

6. The device as claimed in claim 5 in which there is a printed circuit including electronic components mounted thereon, said housing is mounted thereon and said actuating rod is sufficiently spaced from said housing base so that electronic components may be mounted in immediate proximity to said housing.

7. The device as claimed in claim 1 in which said actuating rod includes a transverse stop collar fixed thereon, said stop collar including two mutually opposed stop faces with said transverse plate being able to move into engagement and bear against one stop face and said return spring means bearing against the other stop face, such that when said device is reset by applying a reset force to said actuating rod in a direction opposite said tripping force to reset said transverse plate into said contact position, said transverse plate is substantially free of said reset force.

8. The device as claimed in claim 7 in which there are auxilary spring means bearing against said transverse plate for applying a force on said transverse plate in a direction tending to apply said transverse plate against said one stop face, said auxiliary spring means exerting on said transverse plate a force substantially less than said force of said return spring means on said other stop face, such that when said device is reset, said transverse plate is reset into said contact position with said force of said auxiliary spring means.

* * * * *

UNITED STATES PATENT AND TRADEMARK OFFICE

CERTIFICATE OF CORRECTION

PATENT NO. : 4,213,109

DATED : July 15, 1980

INVENTOR(S) : Bruno Marcoz

It is certified that error appears in the above-identified patent and that said Letters Patent are hereby corrected as shown below:

On the title page, item [73], after "C.G.A.E.,"

insert --S.A.T.E.L.E.M.,--.

Signed and Sealed this

*Twenty-fourth* Day of *February 1981*

[SEAL]

*Attest:*

RENE D. TEGTMEYER

*Attesting Officer*

*Acting Commissioner of Patents and Trademarks*